US005607053A

United States Patent [19]

Sumiyoshi

[11] Patent Number: 5,607,053

[45] Date of Patent: Mar. 4, 1997

[54] GOLF CLUB STORING DEVICE

[76] Inventor: Yoshiyasu Sumiyoshi, 19-25, Imagawa 1-chome, Chuo-ku, Fukuoka-shi, Fukuoka, Japan

[21] Appl. No.: 311,225

[22] Filed: Sep. 23, 1994

[30] Foreign Application Priority Data

May 30, 1994 [JP] Japan ..... 6-117272
Jun. 6, 1994 [JP] Japan ..... 6-124084

[51] Int. Cl.[6] ..... A63B 55/00

[52] U.S. Cl. ..... 206/315.2; 248/96; 211/70.2; 206/315.3

[58] Field of Search ..... 273/32 E; 224/254, 224/274; 206/315.2, 315.3, 315.4, 315.5, 315.7, 315.8; 211/60.1, 70.2; 248/96, 156; 294/148, 149, 159

[56] References Cited

U.S. PATENT DOCUMENTS 4,136,724 1/1979 Leitzel ..... 273/32 E
5,082,218 1/1992 Hoffman ..... 248/96

*Primary Examiner*—William M. Pierce

*Attorney, Agent, or Firm*—Jordan and Hamburg

[57] ABSTRACT

A golf bag storing device or a golf bag which can be stably placed on the indoor floor or on the golf cart. The golf club storing device comprises a support frame structure consisting of an upper frame and a lower frame and elongated longitudinal connecting frame means for connecting the upper frame and the lower frame, and a plurality of longitudinal sleeve-like club storing bags which is preferably made of extendible and shrinkable material and bridges the upper frame and the lower frame, each club storing bag having a club head inserting opening at the upper end thereof. Accordingly, the golf clubs can be smoothly inserted into the club storing bags with the club heads thereof ahead so that the gravity of the golf club storing device and the gravity of the golf bag which stores the golf club storing device are positioned at the lower portion thereof. Therefore, the golf club device and the golf bag can be stably mounted on the room floor or on the golf cart so that the damage on the golf club or the club head which tend to occur by tumbling of the golf club storing device and the golf bag or the damage on floors at the time of bumping of the club head on the floors can be effectively prevented.

11 Claims, 6 Drawing Sheets

GOLF CLUB STORING DEVICE

BACKGROUND OF INVENTION

This invention relates to a golf bag storing device or a golf bag which can be stably placed on the indoor floor or on the golf cart.

The golf bag which stores various kinds of golf clubs differing in ball flying distances or usages is made of a cylindrical body having a bottom thereof closed while an upper end thereof open-ended. The golf clubs are stored in the golf bag, with the club heads thereof protruding upwardly or being exposed from the upper opening of the golf bag.

The conventional golf bag, however, has following problems.

① Since the golf clubs have centers of gravity at the club heads thereof respectively, the golf bag which stores these golf clubs, as a whole, has the center of gravity at the upper portion thereof. Accordingly, when the bag is placed on the floor or on the golf cart, the golf bag becomes unstable and tends to turn down. In such a case, the club heads strike the hard floor or the club heads bump each other thus injuring the club heads or the floor surface.

② For preventing the bumping between club heads of the golf clubs, each club head is usually covered with a cap. Accordingly, during the playing, the player must frequently remove the cap from or mount the cap on the club head. Such a behavior is, in general, cumbersome and may give rise to a chance to lose the cap.

SUMMARY OF THE INVENTION

Accordingly, it is an object of the present invention to provide the golf club storing device or the golf bag which can solve these problems.

The invention relates to a golf club storing device comprising a) a support frame structure defining a bag storing space therein, and b) a plurality of longitudinal sleeve-like club storing bags which are vertically disposed and stored in said bag storing space, wherein each club storing bag has a club head inserting opening at the upper end thereof.

This invention relates also to a golf club storing device comprising a) a support frame structure consisting of an upper frame a lower frame, and elongated longitudinal connecting frame means or central support strut for connecting the upper frame and the lower frame, and b) a plurality of longitudinal sleeve-like club storing bags which are preferably made of extendible and shrinkable material and bridge the upper frame and the lower frame, each club storing bag having a club head inserting opening at the upper end thereof.

In the above construction, this invention is also characterized by following features.

① The opened area of the club head inserting opening is at least greater than a vertical projection area of a club head of the golf club.

② The extendible and shrinkable material is a synthetic cloth material having an extendible and shrinkable property.

③ The extendible and shrinkable material is a synthetic resin made net having an extendible and shrinkable property.

④ A grip or a shoulder belt is attached to the support frame structure of the golf club storing device.

⑤ The lower end of the golf club storing device is connected to the lower frame by means of fastening means.

⑥ The upper frame of the support frame structure is inclined frontwardly.

⑦ A usual golf bag is utilized as the support frame structure and the upper frame and the lower bottom plate are respectively used as the upper frame and the lower frame thereof respectively.

⑧ The golf club storing device of one of any preceding is replaceably disposed in the bag body having an upper opening and a closed bottom thereof and a part of either of the longitudinal connecting frame means or the central connecting strut of the support frame is made of a longitudinal storing box body and a golf club storing portion is defined in the longitudinal storing box and golf clubs are stored in the golf club storing portion in such a manner that the club heads protrude upwardly from the upper opening of the golf bag.

DETAILED DESCRIPTION OF DISCLOSURE

Hereinafter, the present invention is explained in detail in view of embodiments shown in the attached drawings.

Figure 1:
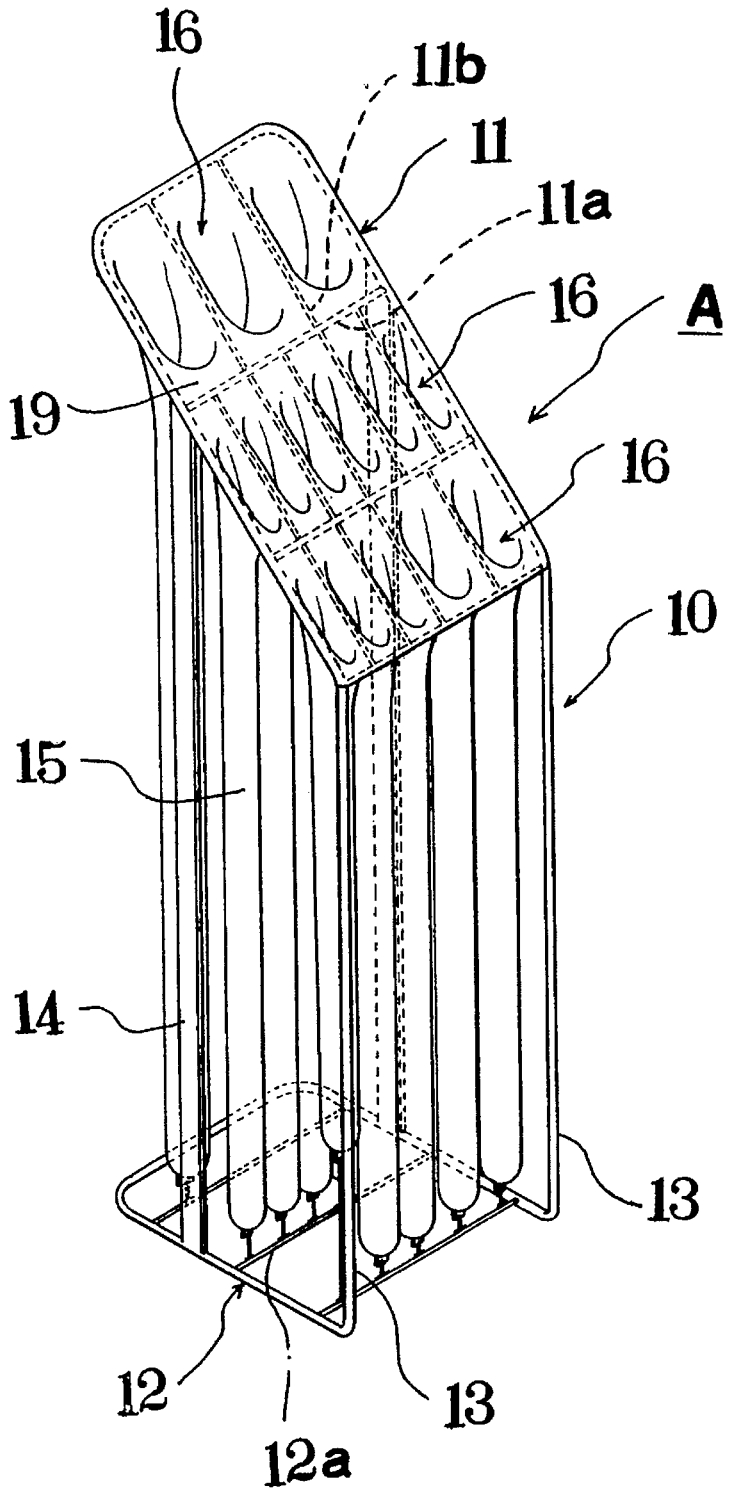
FIG. 1 is a perspective view of the golf club storing device according to the first embodiment of this invention.

As shown in FIG. 1, a support frame body 10 which forms an outer shell of a golf club storing device it according to this invention comprises an upper frame 11 of an elongated rectangular shape which is disposed in a frontwardly inclined manner, a lower frame 12 of an elongated rectangular shape which is disposed below the upper frame 11 in a horizontal condition and has approximately the same vertical projection area as that of the upper frame 11, and a pair of front and rear vertically elongated connecting frames 13, 14.

The upper frame 11 is divided into a plurality of rectangularly shaped spaces by a plurality of lateral ribs 11*a* and a plurality of longitudinal ribs 11*b* and a plurality of club head inserting openings 16 which are described later are defined in the respective rectangularly shaped spaces.

The lower frame 12 is divided into a plurality of rectangularly shaped spaces with the same lateral width as that between the lateral ribs 11*a* of the upper frame 11.

Figure 2:
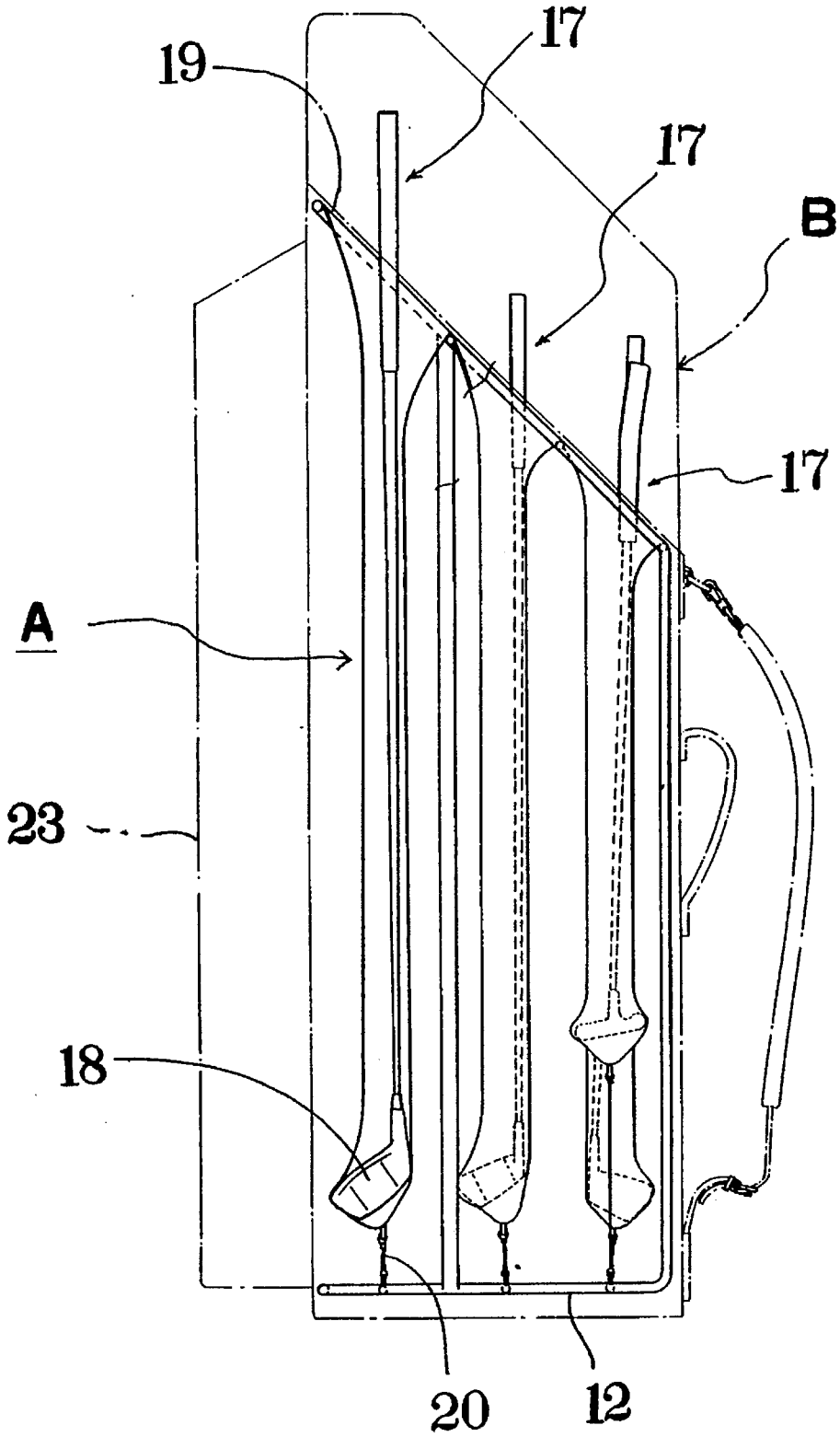
FIG. 2 is a side view of the golf bag provided with the above mentioned golf club storing device.

To explain the inner construction of the support frame body 10, as shown in FIG. 1 and FIG. 2, a plurality of club storing bags 15, each of which has a vertically elongated sleeve-like construction and is made of an extendible and shrinkable material are arranged parallel between the upper and lower frames 11, 12 of the above-mentioned support frame body 10.

Each club storing bag 15 has an upper end opening thereof positioned within the rectangularly shaped space of the upper frame 11 to form a club head inserting opening 16. The size of the club head opening 16 is preferably determined such that it is greater than the contour of a club head 18 of a golf club 17 to be stored in the club storing bag 15 which is integrally attached to the club head inserting opening 16.

The length of the club storing bag 15 is determined by the length of the golf club 17 to be stored therein.

Each club storing bag 15 has the upper end opening thereof connected to a support plate 19, which is extended over the upper surface of the upper frame 11 and is made of the same extendible or shrinkable material by threading or welding. Each club storing bag 15 has the lower end thereof connected to the lateral ribs 12*a* of the lower frame 12 by fastening means 20.

Furthermore, in FIG. 2, the golf club storing bag A having the above-mentioned construction is stored in a golf bag B of a conventional type having an open-ended upper end and a closed bottom.

Next, the manner of using the golf club storing means A having the above mentioned construction is explained hereinafter.

Usually, the golf club storing means A is mounted in the golf club bag B from an aesthetic point of view.

In this embodiment, the size of the club head inserting opening 16 mounted on the upper end of each club storing bag 15 is made greater than the outer size of the club head 18 of the golf club 17 and the upper frame 11 is inclined frontwardly so that, as shown in FIG. 2, the golf club 17 can be smoothly inserted into the club head storing bag 15 with the club head 18 inserted ahead.

As shown in FIG. 2, when all golf clubs 17 are stored in the club storing bags 15, the club head 18 of each golf club 17 is positioned at the lower portion of the golf bag B so that the center of gravity of the golf club 17 is also positioned at the lower portion of the golf bag B. As a result, the center of gravity of the golf club storing device A and the center of gravity of the golf bag B which stores the golf club storing device a are positioned at the lower portion thereof.

Accordingly, the golf club storing device A and the golf bag B can be stably mounted on the room floor or on the golf cart so that the damage to the golf club 17 or the club head 18, which tends to occur by tumbling of the golf club storing device A and the golf bag B, or the damage to floors at the time of striking of the club head 18 on the floors can be effectively prevented.

Furthermore, the golf clubs 17 are stored in the club storing bags 15 respectively and the club storing bag 15 is made of a resilient material having an extendible and shrinkable property. The lower end of the golf club storing bag 15 is fixedly connected to the lower frame 12 by fixing means 20.

Accordingly, within the golf club storing device A and the golf bag B, the golf club 17 can be smoothly inserted in or taken out from each club storing bag 15 while effectively preventing the entanglement of the golf clubs 17, especially the club heads 18 of the golf clubs 17.

Furthermore, since the club storing bag 15 is used also as a shock absorbing member, the bag 15 can prevent the club heads 18, 18 from bumping into each other or interfering with each other in the golf bag B, whereby the damage to the club heads 18 caused by bumping or interfering is minimized.

The club storing bag 15 is preferably made of thick woven cloth or net which is made of synthetic resin, such as nylon, because they are readily available and have high durability and elastic properties.

Furthermore, in this embodiment, as shown in FIG. 1, to make the support frame body 10 light-weight, the front vertical connecting frame 13 and the lower frame 12 may be made by bending a single bar-like member, while the rear vertical connecting frame 14 is made of a plate-like member to assure high rigidity of the support frame body 10.

Furthermore, the support frame body 10 may be made of a conventional sleeve which has the upper end thereof open-ended while the lower end thereof closed, and which usual golf bag one of ordinary skill in the art recognizes has an upper frame and a bottom plate, wherein the upper frame and the bottom plate thereof can be used as the upper frame 11 and the lower frame 12 of the support frame body 10 respectively.

As shown in FIG. 1, the golf bag B is provided with an auxiliary storing portion 23 on a peripheral wall thereof for storing a towel, rain Hear, wind breakers or the like.

A second embodiment relates to a golf club storing device C which can be independently used, as opposed to the golf club storing device A of the first embodiment which is used in a form where the golf club storing device A is mounted in the golf bag B.

Figure 3:
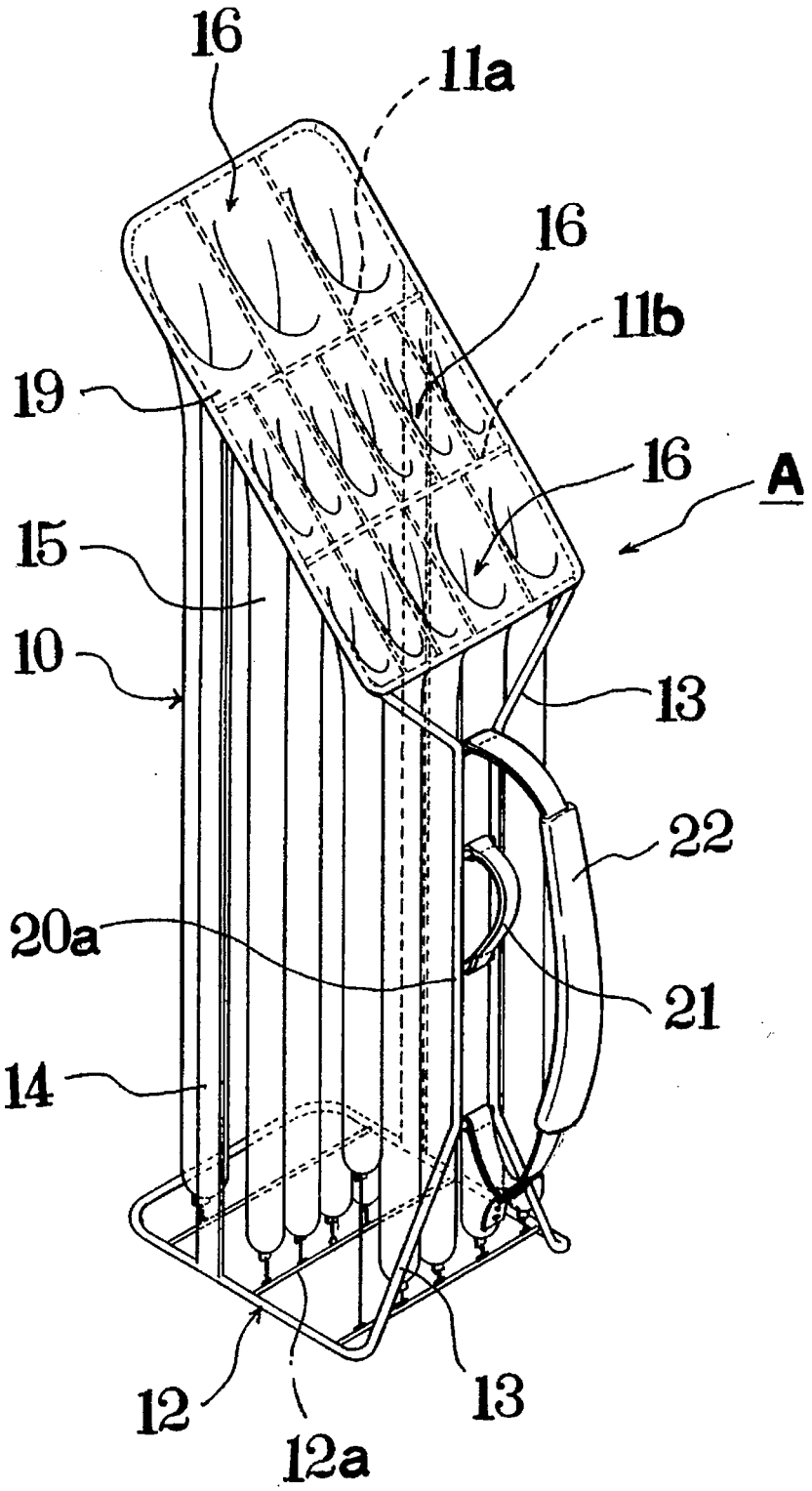
FIG. 3 is a perspective view of the golf club storing device according to the second embodiment of this invention.

Namely, in the golf club storing device C shown in FIG. 3, a pair of front vertical connecting frames 13, 13 have the central portions 20*a* thereof converged and a grip 21 and a shoulder belt 22 are mounted on the converged central portion 20*a*.

Due to such a construction, holding the grip 21 or suspending the shoulder belt 22 on the shoulder, the golf club storing device C according to this invention can be readily carried.

A third embodiment is also a modification of the golf club storing device A as described in the first embodiment and is characterized in concealing the support frame body 10 from outside with the club storing bags 15.

Figure 4:
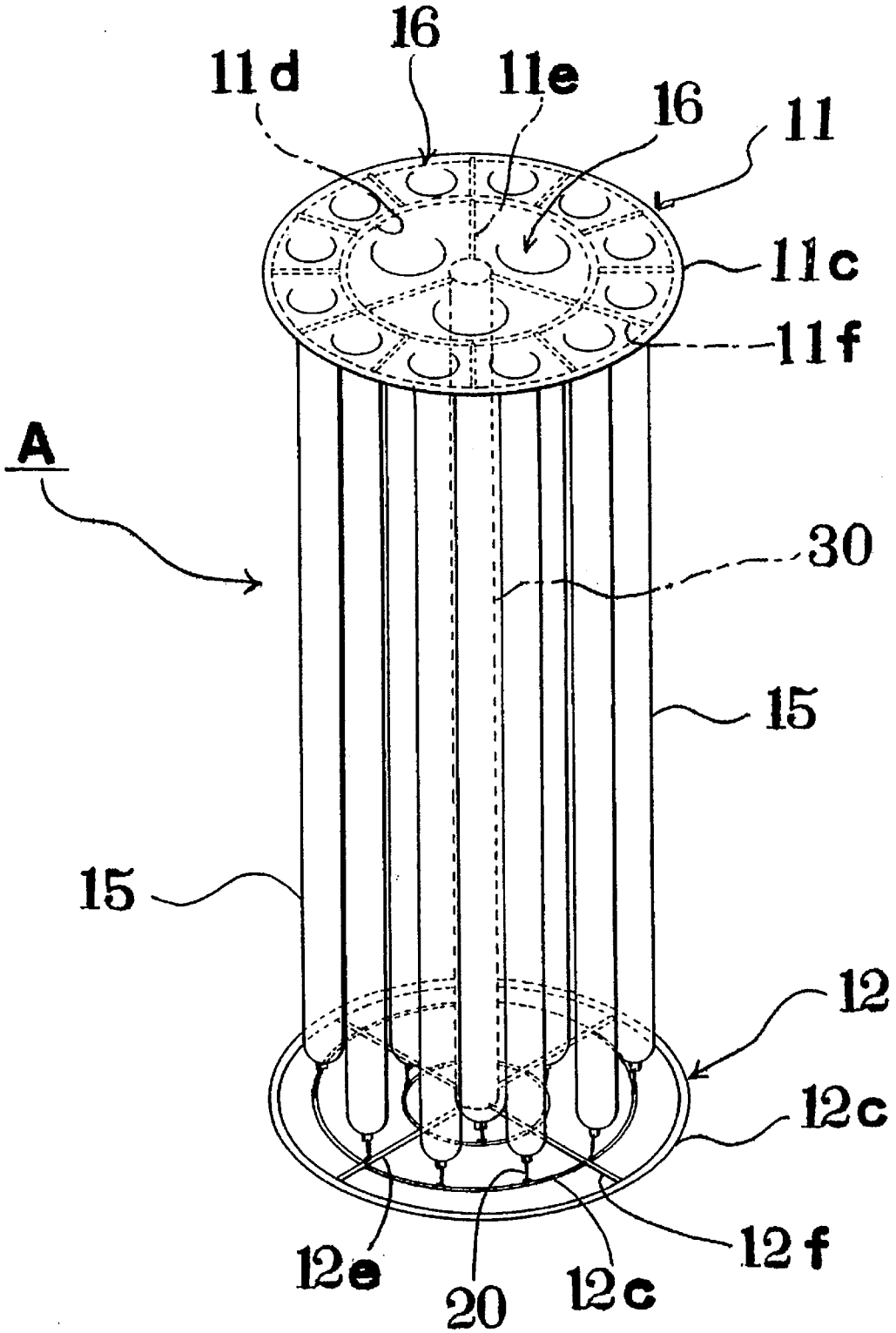
FIG. 4 is a perspective view of the golf club storing device according to the third embodiment of this invention.

Namely, as shown in FIG. 4, a support frame body, which forms the outer shell of a golf club storing device D comprises a pair of upper and lower frames 11', 12' which are made of circular plates and are arranged in a vertically spaced apart manner and a central connecting strut 30 which connects the central portions of the upper and lower frames 11', 12'.

The upper frame 11' comprises concentric outer and inner ring frames 11*c*, 11*d*, a plurality of radial ribs 11*e* which divide a circular space defined within the inner ring frame 11*c* and a plurality of radial ribs 11*f* which divide an annular space between the outer and inner ring frames 11*c*, 11*d*. Between the radial ribs 11*e*, 11*e* and 11*f*, 11*f*, a plurality of arcuate rectangular spaces are defined and the club head inserting opening 16' is formed at each rectangular space.

The lower frame 12' also has the same arrangement as the upper frame 11' and comprises a concentric outer and inner ring frames 12*c*, 12*d*, a plurality of radial ribs 12*e* which divide a circular space defined within the inner ring frame 12*c* and a plurality of radial ribs 12*f* which divide an annular space between the outer and inner ring frames 12*c*, 12*d*.

Around the central connecting strut 30 and between the upper and lower frames 11', 12' of the support frame body 10, a plurality of club storing bags 15, each of which has a vertically elongated sleeve like construction and is made of an extendible and shrinkable material, are arranged in parallel and in a circumferentially spaced apart manner. Each club storing bag 15' is made of a resilient material having an extendible and shrinkable property and each club storing bag 15' has the lower end thereof fixedly connected to the lower frame 12' by the fastening means 20. Due to such a construction, the central connecting strut 30 can be concealed by a plurality of club storing bags 15' so that the strut 30 cannot be seen from outside, thus enhancing the aesthetic effect of the golf club storing bag D.

Furthermore, since the central connecting strut 30 is arranged at the central portion of the golf club storing device D, the center of gravity of the golf club storing device D can be positioned at the center thereof. Accordingly, the golf club storing device D can enhance the stable storing device mounting property coupled with the stable storing device supporting effect which is brought about by inserting of the golf club 17 with the club head 18 ahead or downwardly.

Still furthermore, the golf club storing device D is provided with fifteen club storing bags 15' so that one club storing bag 15' may be used for storing an umbrella.

Figure 5:
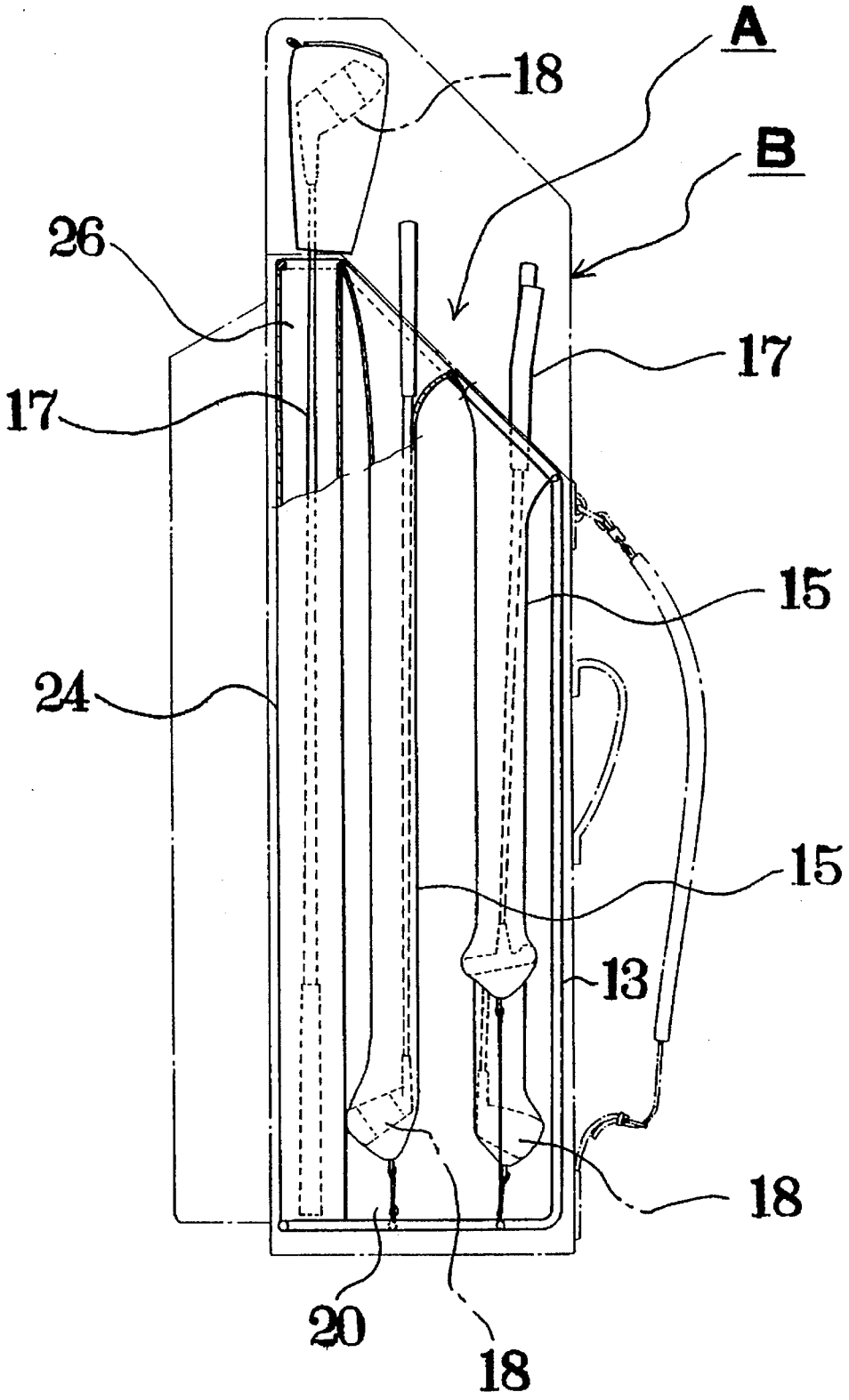
FIG. 5 is a side view of the golf club storing device according to the fourth embodiment of this invention.
Figure 6:
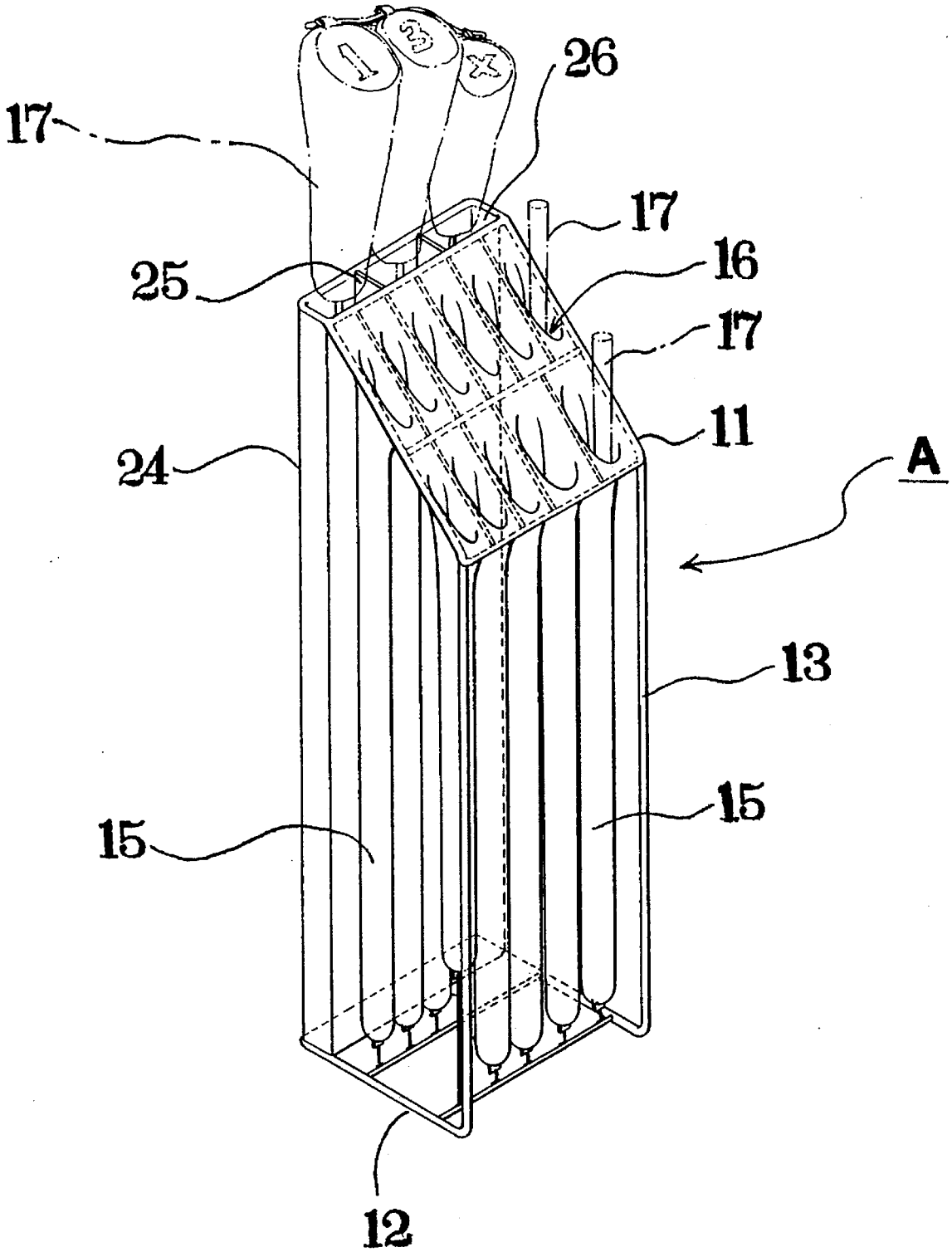
FIG. 6 is a perspective view of the golf club storing device according to the fourth embodiment of this invention.

A fourth embodiment is characterized in that, as shown in FIG. 5 and FIG. 6, a plurality of golf clubs 17 are stored in the golf club storing bag A as in the case of a conventional golf bag where the club heads 18 of the golf clubs 17 protrude outwardly from the upper openings of the golf bag B, while remaining golf clubs 17 are stored in the golf bag B in the same manner as described in the previous first to third embodiments such that the club heads 18 are positioned at the lower portion of the club storing bags 15 respectively.

Namely, as shown in FIG. 5 and FIG. 6, a support frame body is provided with a vertical storing box 24 having a flattened rectangular cross section in lieu of a pair of plate like rear vertical connecting frames 14. The storing box 24 has the inner space thereof divided into a plurality of golf club storing portions 26 by a plurality of partitions 25.

As shown in FIG. 6, a plurality of golf clubs 17 each of which has the big club head 18 can be stored in these golf club storing portions 16 as in the case of the conventional golf bag, namely, with the club heads 18 protruding upwardly from the upper openings of the golf bag B.

On the other hand, the support frame body is provided with a plurality of club storing bags 15 which are arranged parallel between upper and lower frames 11", 12" and the golf clubs 17 are stored in the club storing bags 15 in such a manner that the club heads 18 are positioned at the lower portion of the club storing bags 15 respectively.

Accordingly, in this embodiment, compared to a case in which the golf clubs 17 are stored in the golf club storing device A in such a manner that all golf clubs 17 are stored in the club storing bags 15 with the club heads 18 positioned at the lower portion thereof, the golf club storing device E according to this embodiment makes the entire construction thereof more compact.

Although the invention is explained in view of several embodiments, the invention is not restricted to the construction described in the embodiments, but rather includes at least the following modifications within the scope of claims.

① The club storing bags are prepared separately and each club storing bag has the upper end thereof separately connected to the upper frame of the support frame body.

② In case the support frame body is made of a material having light weight but high strength, such as light-weighted metal or polyamide resin, the entire construction of the golf club storing device or the golf bag is made considerably compact so that it is readily carried and the golfer can play golf without a caddie.

③ Providing a drying agent at the bottom of the club storing bag, the club head of the golf club, especially such as wood-made club, is dried by merely inserting the golf club into the club storing bag.

④ In lieu of making the club storing bag with net material, apertures or slits can be formed in the bottom of the club storing bag to prevent the soil or sand from accumulating in the club storing bag.

⑤ For facilitating the recognition of the kinds of golf clubs, seals or stamps provided with numbers are adhered to grips of the golf clubs which protrude upwardly from the golf club inserting openings of the golf storing bag.

As has been described heretofore, the present invention has following advantages.

① In this invention, the golf club storing device comprises a) a support frame structure consisting of an upper frame and a lower frame and elongated longitudinal connecting frame means for connecting the upper frame and the lower frame, and b) a plurality of longitudinal sleeve-like club storing bags which are preferably made of extendible and shrinkable material and bridge the upper frame and the lower frame, each club storing bag having a club head inserting opening at the upper end thereof.

Accordingly, the golf clubs are smoothly inserted into the club storing bags with the club heads thereof ahead so, that the center of gravity of the golf club storing device and the center of gravity of the golf bag which stores the golf club storing device are positioned at lower portions thereof. Therefore, the golf club device and the golf bag can be stably mounted on the room floor or on the golf cart so that the damage to the golf club or the club head, which tends to occur by tumbling of the golf club storing device and the golf bag, or the damage to floors from striking of the club head on the floors is effectively prevented.

② The golf clubs are stored in the club storing bags respectively and the club storing bag is made of a resilient material having an extendible and shrinkable property. The lower end of the golf club storing bag is fixedly connected to the lower frame by a fixing means. Accordingly, within the golf club storing device and the golf bag, the golf club is smoothly inserted in or taken out from each club storing bag while effectively preventing the entanglement of the golf clubs, especially the club heads of the golf clubs.

③ Since the club storing bag is used also as a shock absorbing member, the bag can prevent the club heads from bumping into each other or interfering with each other in the golf bag, whereby the damage on the club heads caused by bumping or interfering can be minimized.

I claim:

1. A device for storing golf clubs comprising:

a support frame including an upper frame, a lower frame, and longitudinally elongated connecting frame means for connecting the upper frame and the lower frame;

elongated tubular bags for storing the golf clubs, each of which is made of an elastic material;

said upper frame defining an inner space thereof and having upper partition members partitioning said inner space into upper frame apertures, for accepting one golf club in each of said upper frame apertures;

said lower frame defining an inner space thereof and having lower partition members within said inner space and aligned with said upper frame apertures;

said elongated tubular bags each having a top opening, for accepting said golf clubs head first, with a perimeter edge thereof being one of formed integrally with or fastened to said upper partition members about a perimeter of one of said upper frame apertures to maintain said top openings in an open state;

said elongated tubular bags each having a closed bottom connected to one of said lower partition members to maintain said elongated tubular bags apart from each other and elongated; and said top openings each having a sufficient size for accepting a vertical projection area of a club head of a golf club to be inserted therein.

2. A golf club storing device according to claim 1, wherein the elastic material is a synthetic resin-made cloth.

3. A golf club storing device according to claim 1, wherein the elastic material is a synthetic resin-made net.

4. A golf club storing device according to claim 1, wherein bottoms of said elongated tubular bags for storing the golf clubs are connected to the lower frame partition members with fastening means extending therebetween.

5. A golf club storing device according to claim 1, wherein the upper frame of the support frame is inclined frontward with respect to said lower frame.

6. A device for storing golf clubs according to claim 1, wherein said longitudinally elongated connecting frame means comprises:

a pair of front vertical frame members and a pair of rear vertical frame members;

one of said pair of front vertical frame members connecting a front portion of said upper frame to a front portion of said lower frame and another of said pair of front vertical frame members connecting another front portion of said upper frame to another front portion of said lower frame;

one of said pair of rear vertical frame members connecting a rear portion of said upper frame to a rear portion of said lower frame and another of said pair of rear vertical frame members connecting another rear portion of said upper frame to another rear portion of said lower frame; and a central portion of one of said pair of front vertical frame members being connected to a central portion of another of said pair of front vertical frame members.

7. A golf club storing device according to claim 6, wherein a grip or a shoulder belt is attached to a portion where the central portions of said pair of vertical front frames are connected to each other.

8. A device for storing golf clubs according to claim 1, wherein:

said upper partition members include first upper partition members and second upper partition members;

said upper frame has first and second side members connected by said first upper partition members;

said upper frame has front and rear members connected by said second upper partition members;

said first and second upper partition members divide the inner space of said upper frame into rows of said upper frame apertures, each of the rows comprising a plurality of sections disposed sideways; and the inner space of said lower frame is divided into rows of sections by the lower partition members, each of the rows of the sections comprising a plurality of sections disposed sideways.

9. A device for storing golf clubs according to claim 1, wherein:

the upper frame is of a circular shape;

the lower frame is of a circular shape and a size thereof substantially equal to that of the upper frame;

the longitudinally elongated connection means is disposed in a central position coaxially with the upper frame and the lower frame;

the longitudinally elongated connection means connects the upper frame to the lower frame;

said upper partition members including first connection members disposed coaxially within the inner space of the upper frame to divide the inner space into a plurality of sections in a radial arrangement;

said upper partition members including second connection members disposed radially to divide the sections into generally rectangularly-shaped subsections; and means for supporting the lower partition members coaxially within the lower frame to define sections.

10. A golf club storing apparatus comprising:

a golf bag having an open-ended upper opening and a closed bottom and a golf club storing device for storing golf clubs replaceably disposed in said golf bag; and said golf club storing device having:

a support frame including an upper frame, a lower frame, and longitudinally elongated connecting frame means for connecting the upper frame and the lower frame;

elongated tubular bags for storing the golf clubs; each of which is made of an elastic material;

said upper frame defining an inner space thereof and having, upper partition members partitioning said inner space into upper frame apertures, for accepting one golf club in each of said upper frame apertures;

said lower frame defining an inner space thereof and having lower partition members within said inner space and aligned with said upper frame apertures;

said elongated tubular bags each having a top opening, for accepting said golf clubs head first, with a perimeter edge thereof being one of formed integrally with or fastened to said upper partition members about a perimeter of one of said upper frame apertures to maintain said top openings in an open state;

said elongated tubular bags each having a closed bottom connected to one of said lower partition members to maintain said elongated tubular bags apart from each other and elongated; and said top openings each having a sufficient size for accepting a vertical projection area of a club head of a golf club to be inserted therein.

11. A golf club storing apparatus according to claim 10, wherein:

a longitudinal box body is disposed in a position corresponding to a space defined and delimited by a lateral rear row of the upper frame apertures of said upper frame and a lower frame lateral rear row section defined by one of said lower frame partition members and said lower frame; and the longitudinal box body has box partitions defining sections into each of which one of said golf clubs is insertable with a head portion thereof directed to a top of the longitudinal box body and a grip portion thereof directed to a bottom of said longitudinal box body.

* * * * *